US006227533B1

(12) United States Patent
Jang

(10) Patent No.: US 6,227,533 B1
(45) Date of Patent: May 8, 2001

(54) MULTI-FUNCTIONAL SHEET FEEDING APPARATUS

(75) Inventor: Heung-Kyu Jang, Kyungki-do (KR)

(73) Assignee: Samsung Electronic Co. Ltd., Suwon (KR)

( * ) Notice: Subject to any disclaimer, the term of this patent is extended or adjusted under 35 U.S.C. 154(b) by 0 days.

(21) Appl. No.: 09/198,400

(22) Filed: Nov. 24, 1998

(30) Foreign Application Priority Data

Nov. 24, 1997 (KR) ..... 97-62291

(51) Int. Cl.[7] ..... B65H 1/06

(52) U.S. Cl. ..... 271/109; 271/147; 271/145; 271/157; 271/158; 271/9.09; 271/9.11; 271/9.13

(58) Field of Search ..... 271/145, 147, 271/157, 158, 160, 9.09, 9.11, 9.13

(56) References Cited

U.S. PATENT DOCUMENTS 4,285,510 * 8/1981 Kanno et al. ..... 271/127
4,429,863 * 2/1984 Itoh et al. ..... 271/9.09
5,120,040 * 6/1992 Worley ..... 271/9.07
5,222,722 * 6/1993 Kamano ..... 271/9.09

* cited by examiner

*Primary Examiner*—Donald P. Walsh
*Assistant Examiner*—Jonathan R. Miller
(74) *Attorney, Agent, or Firm*—Robert E. Bushnell, Esq.

(57) ABSTRACT

A sheet feeding device that may be constructed using a first tray mounted in a frame and biased by an elastic member to bring the paper stacked on the first tray into engagement with a pickup roller. A finger is pivotally attached to the frame to force the paper loaded from the first tray to be loaded sequentially. A second tray is attached to the frame and has an end that forms a document guide that is interposed between the finger and the pickup roller. Alternatively, the second tray can end before the pickup roller and a film can be attached to the second tray to form a document guide that extends between the pickup roller and the finger. Regardless of the method used to form a document guide, the document guide allows a user to intersperse a manually fed document between documents that are being loaded from a separate tray using an automatic document loading process.

20 Claims, 4 Drawing Sheets

MULTI-FUNCTIONAL SHEET FEEDING APPARATUS

CLAIM OF PRIORITY

This application makes reference to, incorporates the same herein, and claims all rights accruing thereto under 35 U.S.C. §119 through my patent application entitled A Sheet Feeding Apparatus earlier filed in the Korean Industrial Property Office on Nov. 24, 1997 and there duly assigned Ser. No. 1997/62291.

BACKGROUND OF THE INVENTION

1. Field of the Invention

The present invention relates to a sheet feeding apparatus for an electrophotographic device and, more particularly, to a multi-functional sheet feeding device that can intersperse a manually fed document between documents that are being loaded from a separate tray using an automatic document loading process.

2. Background Art

An image formation apparatus (e.g., a printer, scanner, facsimile or copier) must often accommodate printable mediums having a thickness or dimensions different from that of standard paper. Envelopes, postcards, transparencies, labels and resume paper are just a few examples of the different printable mediums that a sheet feeder must accommodate. A sheet feeder may be constructed to use a tray that supplies paper to a printer. The tray often has an adjustment lever allowing the paper to be moved away from a pickup roller in order to load additional sheets of paper into the tray. After loading additional paper, the adjustment lever is moved in a direction opposite that used for preparing the tray to receive additional paper causing the pickup roller to press against the paper on the tray and then transfer the paper to a transfer roller. Then, the transfer roller transports the sheet of paper to the printer cartridge.

Contemporary image forming devices use one of two kinds of methods to feed sheets into a printer or scanner. One method is to use an automatic paper feeding device that continues to load a multitude of papers as required by a controller. The second method of loading a document is to load the document manually. This normally requires that a user either replace the stack of papers normally being automatically loaded by the computer with the document to be loaded or that the user stop the printing process and position the document on top of the stack of papers currently being used for automatically feeding paper into the image forming or reading device. Having to stop the printing or scanning process of an imaging forming or recording device to change the medium that the device uses can be very inconvenient to a user, results in the waste of time, and thus lowers the printing or recording efficiency of the electrophotographic device.

As such, I believe that it may be possible to improve on the contemporary art by providing a multi-functional sheet feeding device that can intersperse a manually fed document between documents that are being loaded from a separate tray using an automatic document loading process, that reduces the number of components normally required to build sheet feeding device capable of both printing automatically or using a manually fed document from a second tray, that increases the productivity of a user by eliminating the need to stop the automatic sheet loading process to manually feed a document, that is simple to manufacture, and that is economical to produce.

SUMMARY OF THE INVENTION

Accordingly, it is an object of the present invention to provide an improved multi-functional sheet feeding device.

It is another object to provide a multi-functional sheet feeding device that can intersperse a manually fed document between documents that are being loaded from a separate tray using an automatic document loading process, without requiring the adjustment of the paper cassette.

It is still another object to provide a multi-functional sheet feeding device that reduces the number of components normally required to build sheet feeding device that is capable of both printing automatically or printing using a manually fed document from a second tray.

It is yet another object to provide a multi-functional sheet feeding device that increases the productivity of a user by eliminating the need to stop the automatic sheet loading process to manually feed a document.

It is still yet another object to provide a multi-functional sheet feeding device that is easy to manufacture and that is economical to produce.

To achieve these and other objects, a sheet feeding device, or paper cassette, is provided that may be constructed using a first tray mounted in a frame and biased by an elastic member to bring the paper stacked on the first tray into engagement with a pickup roller. A finger is pivotally attached to the frame to force the paper loaded from the first tray to be loaded sequentially. A second tray is attached to the frame and has an end that forms a document guide that is interposed between the finger and the pickup roller. Alternatively, the second tray can end before the pickup roller and a film can be attached to the second tray to form a document guide that extends between the pickup roller and the finger. Regardless of the method used to form a document guide, the document guide allows the paper cassette to intersperse a manually fed document between documents that are being loaded from a separate tray using an automatic document loading process.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
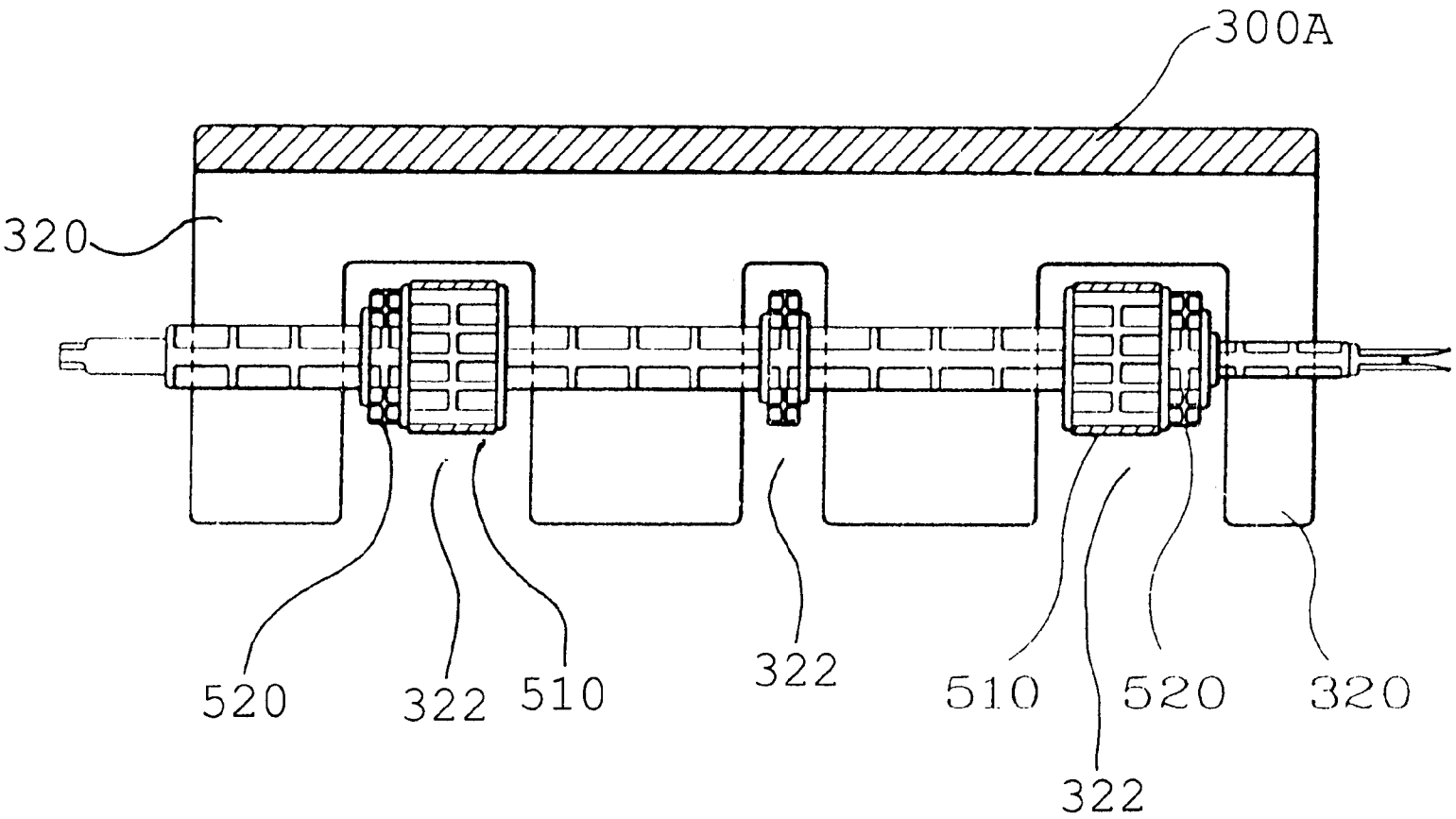
FIG. 1 illustrates a portion of a paper cassette as constructed according to the principles of the present invention.
Figure 2:
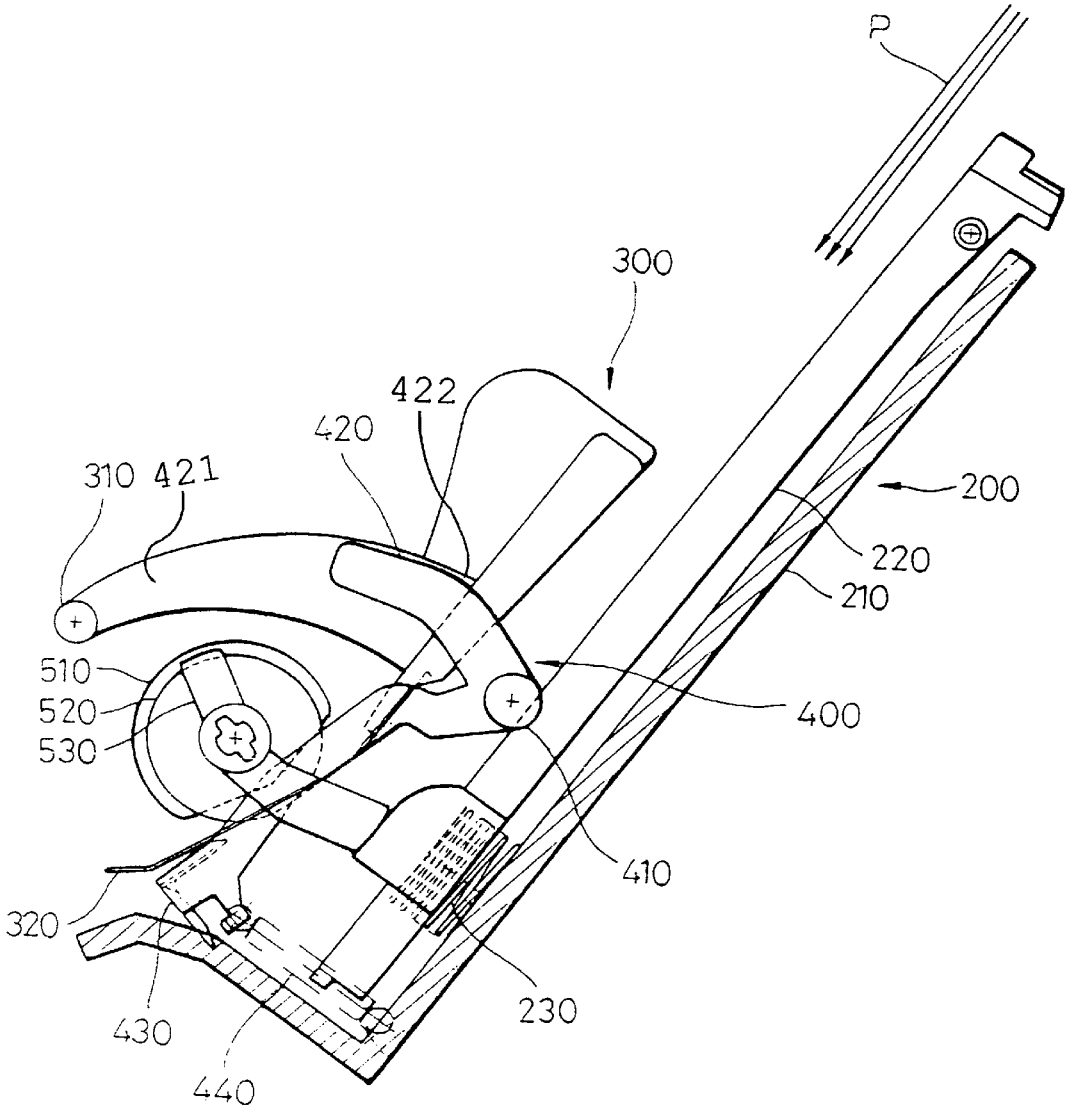
FIG. 2 illustrates a cross-sectional view of a paper cassette as constructed according to the principles of the present invention.
Figure 3:
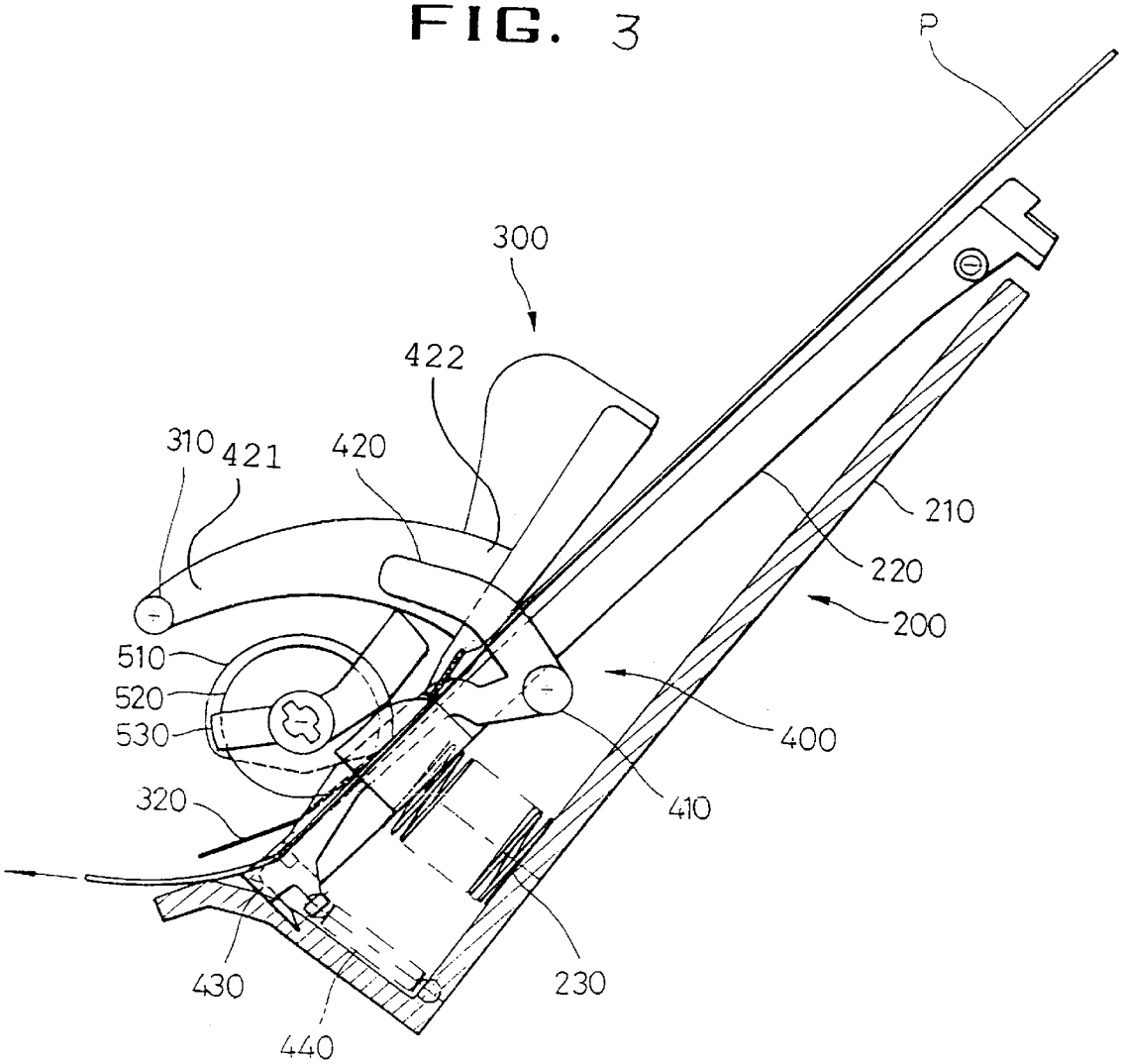
FIG. 3 illustrates a cross-sectional view of the paper cassette of FIG. 2.
Figure 4:
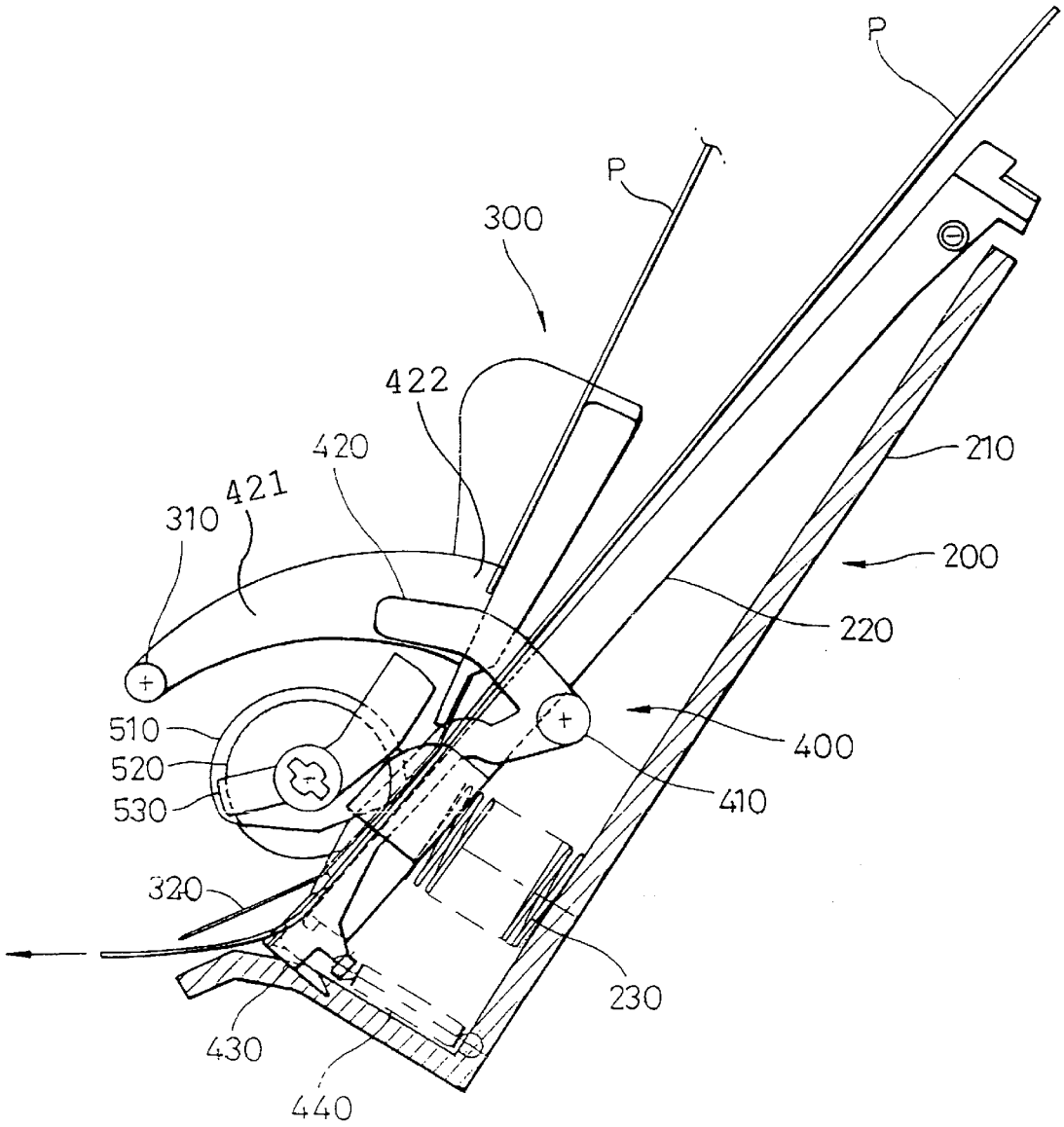
FIG. 4 illustrates a cross-sectional view of the paper cassette of FIG. 2.

Turning now to the drawings, FIG. 1 illustrates the document guide of a paper cassette as constructed according to the present invention, and FIG. 2 through FIG. 4 show cross-sectional views of the paper cassette of FIG. 1. This paper cassette can be used in either an image forming device, such as an inkjet printer, a laser printer, or copier, or in an image reading device, such as a scanner, or in a mult-functional peripheral or office machine.

As shown in FIG. 1, document guide 320 can either be an integral portion of second tray 300A or document guide 320 can be a separate piece that is attached to the second tray via adhesive, or double-sided tape, 300A. As such, the area denoted by reference numeral 300A can be either a portion of the second tray or an adhesive depending on manufacturing preferences. The notation 300A is used for both possibilities as it represents the interface between the second tray and the document guide. Document guide 320 may be manufactured using a thin film and extends between a pickup roller (not shown) and a finger (not shown) that engages paper stacked on the first tray (not shown). The film has slots 322 that allow pickup rollers 510, rollers 520, and a cam to penetrate past the document guide to contact paper stacked on the first tray. The document guide allows for a user to intersperse a manually fed document between documents that are being loaded from a separate tray using an automatic document loading process.

FIG. 2 shows a cross-sectional view of the paper cassette of the present invention. The paper cassette can intersperse a manually fed document between documents that are being loaded from a separate tray using an automatic document loading process. Mannual device part, or second tray, 300 rotates clockwise around hinge 310 to simplify the manual loading papers. First guide 420 connects second tray 300 to frame 210 of paper cassette 200. First end 421 of first guide 420 is attached to hinge 310 and second end 422 of first guide 420 is attached to second tray 300.

Document guide 320, which may be constructed to be very thin, may be either attached to or an integral part of mannual device part 300 and is located between pickup roller 510 and finger 430. Pickup roller 510 loads paper from either first tray 220 or from second tray 300 into the electrophotographic device. Finger 430 ensures that paper that is loaded from the first tray is loaded sequentially, one sheet at a time, into the electrophotographic apparatus.

Pickup cam 530 presses against first tray 220, in an alternating manner to facilitate the sequential loading of paper that is stacked on the first tray. As paper is removed from the first tray finger 430 causes only one sheet to be loaded at a time and is moved upward slightly. The spring is returned to engagement with paper stacked on the first tray by spring 440 that is fixed to frame 210.

If a paper is manually loaded by user, and a printing or scanning operation is being carried out, the paper cassette feeds the paper from second tray 300, denoted P, through document guide 320 between pickup roller 510 and finger 430. Semi-circular pickup roller 510 rotates and cam 530 presses first tray 220 away from the pickup roller. While the pickup roller and any paper that is stacked on the first tray are separated, the pickup roller engages the manually fed document and automatically feeds the manually fed document into the electrophotographic apparatus. After the manually fed document is loaded elastic member 230 biases first tray 220 back into engagement with pickup roller 510. FIG. 3 shows paper P being fed from the first tray in the paper cassette.

Thus, the document guide allows for manually fed documents to be interspersed between documents that are being loaded from a separate tray using an automatic document loading process. Alternatively, the paper cassette may be converted to a manual feeding only mode by rotating finger control part 400 clockwise, as shown in FIG. 2. When the finger control part is rotated clockwise, finger 430 is moved away from the base of the frame separating from paper that is loaded on the first tray. Thus, the finger further elevates document guide 320 above the base of the paper cassette. While in this mode the paper cassette operates only in manual mode.

When in manual mode, if a document is loaded onto second tray 300, this document is picked up and fed by pickup roller 510, and past between idle roller 520 and document guide 320. Having document guide 320 elevated by finger 430 during the manual feeding of documents aids in the transmission of documents in a sequential, sheet by sheet, manner.

FIG. 4 shows the paper cassette in a configuration suitable for the auto feeding of paper into an image forming or reading device without changing the position of second tray 300. Thus, paper may be manually fed, via second tray 300 and document guide 320, into the paper cassette. The paper cassette can then intersperse the manually fed document between documents that are already being loaded from a separate tray using an automatic document loading process. That is, if paper P is inserted into second tray 300 while the paper cassette is automatically feeding paper from the first tray into the electrophotographic device, the pickup roller will engage the manually loaded document while cam 530 separates the first tray from the pickup roller.

As detailed above, the present invention provides a multifunctional sheet feeding device that can intersperse a manually fed document between documents that are being loaded from a separate tray using an automatic document loading process. The design of the present invention reduces the number of components that are normally required to build a sheet feeding device capable of both printing automatically or using a manually fed document from a second tray. In addition, the present invention increases the productivity of a user by eliminating the need to stop an automatic sheet loading process to manually feed a document. The multifunctional sheet feeding device of the present invention is simple to manufacture, and is economical to produce. In addition, print quality on paper that is loaded from the first tray can be improved because contact with the bottom of the film used to form the document guide can reduce the curl generated in paper while the paper is being separated from the stack of paper supported by the first tray.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A paper cassette for an electrophotographic apparatus, comprising:

a frame having a base;

a first tray pivotally mounted to said base in said frame and supporting a plurality of cut sheets for feeding into said electrophotographic apparatus;

an elastic member mounted between said base of said frame and said first tray biasing said first tray away from said frame;

a finger pivotally attached to said frame and causing said plurality of cut sheets to be sequentially fed from said first tray into said electrophotographic apparatus;

a pickup roller attached to said frame for feeding said plurality of cut sheets into said electrophotgraphic apparatus;

a second tray attached to said frame above said first tray, said second tray having an end that extends between said pickup roller and said finger; and said paper cassette capable of interspersing a manually fed document, that is loaded onto said second tray, between said plurality of cut sheets that are being loaded in an automatic and sequential manner from said first tray.

2. The paper cassette of claim 1, further comprised of said end of said second tray being constructed of a film.

3. The paper cassette of claim 2, further comprised of said end of said second tray bearing a plurality of slots allowing said pickup roller to penetrate said second tray, while said manually fed document is not present in said second tray, to contact a topmost sheet of said plurality of cut sheets stacked on said first tray.

4. The paper cassette of claim 3, further comprised of said manually fed document being loaded, during the automatic loading of said plurality of cut sheets, without necessitating a manual adjustment of said paper cassette by a user.

5. The paper cassette of claim 4, further comprised of said second tray being rotatably attached to said frame via a first guide that has a first end and a second end, said first end of said first guide being rotatably attached to said frame and said second end of said first guide being attached to said second tray.

6. The paper cassette of claim 5, further comprised of a finger control part that is rotatably mounted on said frame that causes said finger to both move away from said base of said frame and to push said end of said second tray away from said base of said frame while said first guide is positioned to secure said paper cassette in a position to only accept a manually fed document via said second tray.

7. The paper cassette of claim 6, further comprised of said first guide having a shape substantially similar to a part of a circle ring.

8. The paper cassette of claim 7, further comprising a spring biasing said finger towards said base of said frame.

9. A paper cassette for an electrophotographic apparatus, comprising:

a frame having a base;

a first tray pivotally mounted to said base in said frame and supporting a plurality of cut sheets for feeding into said electrophotographic apparatus;

an elastic member mounted between said base of said frame and said first tray biasing said first tray away from said frame;

a finger pivotally attached to said frame and causing said plurality of cut sheets to be sequentially fed from said first tray into said electrophotographic apparatus;

a pickup roller attached to said frame for feeding said plurality of cut sheets into said electrophotographic apparatus;

a second tray attached to said frame above said first tray;

a film attached to an end of said second tray and extending between said pickup roller and said finger; and said paper cassette capable of interspersing a manually fed document, that is loaded onto said second tray, between said plurality of cut sheets that are being loaded in an automatic and sequential manner from said first tray.

10. The paper cassette of claim 9, further comprised of said film bearing a plurality of slots allowing said pickup roller to penetrate said film, while said manually fed document is not present in said film, to contact a topmost sheet of said plurality of cut sheets stacked on said first tray.

11. The paper cassette of claim 10, further comprised of said manually fed document being loaded, during the automatic loading of said plurality of cut sheets, without necessitating a manual adjustment of said paper cassette by a user.

12. The paper cassette of claim 11, further comprised of said second tray being rotatably attached to said frame via a first guide that has a first end and a second end, said first end of said first guide being rotatably attached to said frame and said second end of said first guide being attached to said second tray.

13. The paper cassette of claim 12, further comprised of a finger control part that is rotatably mounted on said frame that causes said finger to both move away from said base of said frame and to push said film away from said base of said frame while said first guide is positioned to secure said paper cassette in a position to only accept a manually fed document via said second tray.

14. The paper cassette of claim 13, further comprised of said first guide having a shape substantially similar to a part of a circle ring.

15. The paper cassette of claim 14, further comprising a spring biasing said finger towards said base of said frame.

16. A method of loading an electrographic apparatus paper cassette so that a manually fed sheet is interspersed between documents automatically loaded from a tray, said method comprising the steps of:

(1) supporting a stack of sheets of paper on a first tray mounted on the electrographic apparatus, said first tray having an elastic biasing member to bring the sheets of paper into engagement with a pickup roller;

(2) forcing the sheets of paper to be automatically loaded sequentially, by means of a finger member pivotally attached to the electrographic apparatus;

(3) if a sheet of paper is to be manually loaded, feeding said sheet of paper from a second tray, an end of said second tray located between the pickup roller and the finger member, and simultaneously pushing the first tray away from the pickup roller; the pickup roller engaging the manually fed sheet to load it into the electrographic apparatus; and (4) after the manually fed sheet is loaded, pushing the first tray back into engagement with the pickup roller, by means of the elastic biasing member, to permit automatic loading to resume in accordance with steps (1) and (2).

17. In a method of loading documents into an electrographic apparatus via a paper cassette, said method comprising steps for automatically feeding documents into the electrographic apparatus via a pickup roller, the improvement comprising:

a step for interspersing a manually fed document among the documents automatically loaded into the electrographic apparatus, in a manner such that the automatic loading of documents is not terminated and it is not necessary to adjust the cassette.

18. In a paper cassette for an electrographic apparatus, comprising a pickup roller and a first tray for supporting documents to be fed automatically by the pickup roller, the improvement comprising:

a feed means for permitting a document to be fed manually to the electrographic apparatus without stopping the automatic loading of documents and without adjusting the paper cassette.

19. The device of claim 18, wherein the feed means comprises a pivoting finger adapted for separating sheets of paper in a stack.

20. The device of claim 18, wherein the feed means comprises a second tray for supporting a document to be manually fed, said second tray having an end located between the pickup roller and a pivoting finger adapted for separating sheets of paper in a stack.

* * * * *